US005423355A

United States Patent [19]

Greger et al.

[11] Patent Number: 5,423,355

[45] Date of Patent: Jun. 13, 1995

[54] METHOD AND APPARATUS FOR LIMITING STRESSES IN WEFT YARN ADVANCING TOWARDS A WEFT INSERTION MECHANISM

[75] Inventors: Wolfgang Greger, Gundetswil; Paul Lincke, Kollbrunn, both of Switzerland

[73] Assignee: Sulzer Rueti AG, Rueti, Switzerland

[21] Appl. No.: 184,317

[22] Filed: Jan. 21, 1994

[30] Foreign Application Priority Data

Mar. 26, 1993 [EP] European Pat. Off. ..... 93810220

[51] Int. Cl.[6] ..... D03D 47/34

[52] U.S. Cl. ..... 139/450; 139/194; 139/435.1; 139/439

[58] Field of Search ..... 139/450, 194, 435.1, 139/439, 438, 437

[56] References Cited

U.S. PATENT DOCUMENTS

| | | | |
|---|---|---|---|
| 4,513,792 | 4/1985 | Lincke | 139/439 |
| 4,649,965 | 3/1987 | Wenig et al. | 139/439 |
| 5,199,468 | 4/1993 | Aarts et al. | 139/450 |

FOREIGN PATENT DOCUMENTS

| | | |
|---|---|---|
| 0155432 | 9/1985 | European Pat. Off. . |
| 0189497 | 8/1986 | European Pat. Off. . |
| 0389410 | 9/1990 | European Pat. Off. . |

*Primary Examiner*—Andrew M. Falik
*Attorney, Agent, or Firm*—Townsend and Townsend Khourie and Crew

[57] ABSTRACT

A weft yarn (1) leaving a stationary stock bobbin (2) is led through a compressed-air nozzle (6) and a deflector element (16) movable transversely to the direction of weft insertion (arrow 9), to the weft insertion mechanism (11) of a projectile loom. After each weft insertion the weft yarn (1) becomes deflected by the deflector element (16) from a yarn path (1*a*) running stretched into a cranked yarn path (1*c*) and returned towards the stretched yarn path (1*a*) during a following weft insertion. During a predetermined fraction of the weaving cycle which comprises the return of the weft yarn (1) into the stretched yarn path (1*a*), the compressed-air nozzle (6) is acted upon by compressed air so that the weft yarn (1) is additionally accelerated for a short time. After the return of the weft yarn (1) the compressed air feed to the compressed-air nozzle (1) becomes blocked during the remaining part of the weaving cycle. A gentle guidance of the weft yarn is thereby guaranteed with minimum consumption of compressed air and with a simple nozzle arrangement, and the occurrence of a "snatch" upon stretching the weft yarn is prevented. The method is particularly suitable for the processing of sensitive yarn material in looms of high weft insertion power.

14 Claims, 1 Drawing Sheet

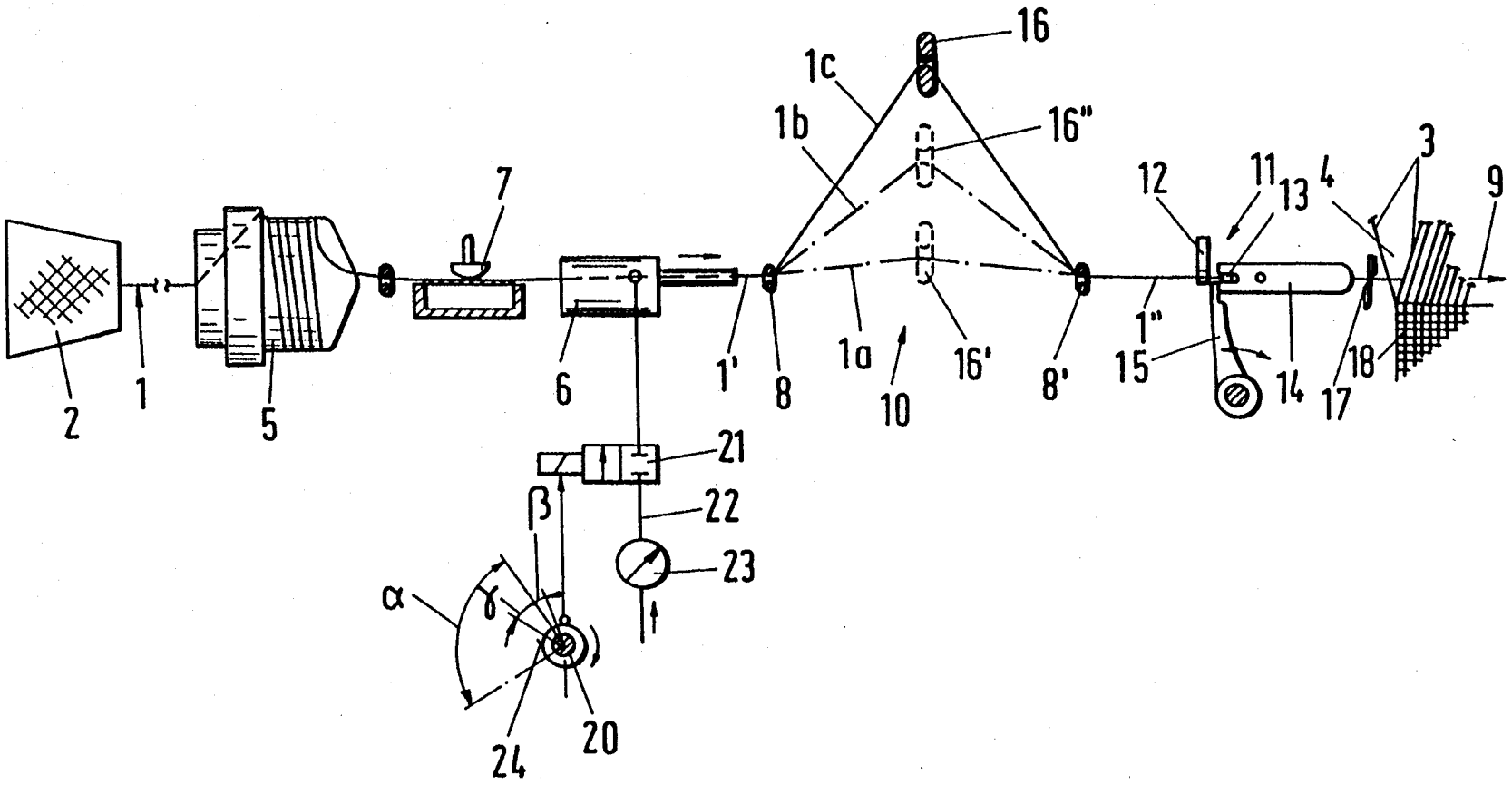
9
3
4
18
17
11
13
14
12
1"
15
16
16"
8'
16'
10
1c
1b
1a
8
1'
21
22
23
6
20
7
24
5
1
2

METHOD AND APPARATUS FOR LIMITING STRESSES IN WEFT YARN ADVANCING TOWARDS A WEFT INSERTION MECHANISM

BACKGROUND OF THE INVENTION

The present invention is concerned with a method of influencing the motion of a weft yarn which has to be drawn off a stock bobbin and runs towards a weft insertion mechanism of a loom, and in particular a projectile loom, At any given time in a weaving cycle the weft yarn is transferred for a weft insertion to a weft insertion member which passes through the shed, where the weft yarn is additionally accelerated at any given time by a compressed-air nozzle arranged between the stock bobbin and the weft insertion mechanism, and after the weft insertion is drawn back by a predetermined length by a deflector element movable transversely to the direction of weft insertion and deflected locally from a yarn path running essentially stretched into a yarn path cranked like a loop, and upon a following weft insertion is returned from the latter at any given time towards the yarn path running stretched.

The invention is further concerned with a loom for the performance of the above-described method.

EP-A-0 155 432 discloses a loom which contains between the stock bobbin and the deflector element a nozzle arrangement with a compressed-air nozzle for accelerating and a compressed-air nozzle for braking the weft yarn which is being fed to the weft insertion mechanism, as well as a compressed-air nozzle arranged between the deflector element and the weft insertion mechanism for transferring the weft yarn to the insertion member. The nozzle intended for accelerating the weft yarn in the known arrangement is acted upon by compressed air during the greater part of the weft insertion process in order to avoid the weft yarn being drawn off by the insertion member alone. Towards the end of the weft insertion process when the insertion member arrives at the catching side of the loom, the feed of compressed air to this accelerator nozzle is shut off and the braking nozzle acting in the opposite direction is acted upon by compressed air. The yarn transfer nozzle is activated each time only before the weft insertion in order to introduce the end of the weft yarn which has to be gripped into the insertion member. An accelerator nozzle which is active during essentially the whole weft insertion period demands a relatively elaborate arrangement and control of the compressed-air supply and consumes a relatively large amount of compressed air. In the case of looms of high weft insertion power, when a loop-shaped length of weft yarn is being returned towards the stretch position, in particular upon stretching out the portion of weft yarn being steadily accelerated by the accelerator nozzle and the weft insertion member, a "snatch" may additionally occur which, when handling sensitive yarn material, e.g., wool, may lead to weft yarn breakage.

SUMMARY OF THE INVENTION

The problem underlying the invention is to achieve a controlled feed of the weft yarn to the weft insertion mechanism and a correspondingly simplified loom which, at relatively low costs, allows gentle guidance of the weft yarn to be fed to the weft insertion mechanism, and by which a snatch loading of the weft yarn, in particular upon returning the deflected length of weft yarn towards the stretched yarn path, is avoided.

Through the method in accordance with the invention the weft yarn is additionally accelerated only during the relatively short initial phase which is critical for snatch loading, by a correspondingly brief feed of compressed air. It has been found that in this way at minimum consumption of compressed air and with a simple nozzle arrangement, in certain circumstances with one single compressed-air nozzle, a reliable return of the weft yarn into the stretched position which is an optimum for the weft insertion is guaranteed, the tension in the weft yarn which is to be inserted being influenced only during an exactly definable time interval which is variable according to various parameters. The occurrence of a "snatch" upon stretching the deflected length of weft yarn may accordingly be prevented and an inadmissible loading of the weft yarn be thereby avoided.

BRIEF DESCRIPTION OF THE DRAWINGS

The single Figure schematically shows the weft yarn path of a projectile loom constructed in accordance with the present invention.

DETAILED DESCRIPTION OF THE PREFERRED EMBODIMENTS

On the illustrated loom a weft yarn 1 is being drawn off a stationary weft yarn stock bobbin 2 which is arranged outside the shed 4 of the loom, formed by the warp threads 3. The weft yarn 1 leaving the stock bobbin 2 is wound onto a drum store 5, drawn off it overhead in the axial direction and led through a yarn brake 7, a compressed-air nozzle 6 and a deflector device 10, into a weft insertion mechanism 11. The deflector device 10 contains two stationary guide eyes 8, 8' and a deflector element 16 arranged to be movable between them and adjustable transversely to the direction of weft insertion for taking up slack in the yarn during certain portions of the weaving cycle as is further described below. In the weft insertion mechanism 11 the end of the weft yarn 1 is transferred by a transfer nozzle or, as shown, a yarn clamp 12 to a weft insertion member or element such as a projectile 14 provided with a weft yarn clamp 13. The projectile 14 may be shot in known manner by a striker lever 15 into the shed 4 to insert the weft yarn 1. On the catching or receiving side of the loom (not shown) the projectile 14 is braked and pushed back by a predetermined amount into a yarn release position.

Slack in the weft yarn resulting from this reverse motion of the projectile 14 is taken up by moving deflector element 16 out of an essentially stretched yarn path 1a (represented in dash-dot line) into an angled yarn path 1b cranked like a loop (also shown in dash-dot line) so that the weft yarn 1 in shed 4 is kept taut. The weft yarn 1 is then beaten up in known manner by a reed (not shown) into the tip of the shed 4 against the cloth 18 being formed there and is cut off by a shear 17 on the weft side. The resulting end of the weft yarn 1 remaining outside the shed 4 is carried back by the yarn clamp 12 from the region of the shear 17 to the position shown for transfer to a further projectile 14 during the next weaving cycle. Additional slack generated during this return motion of the yarn clamp 12 is taken up by moving deflector element 16 from the yarn path **1*b* into angled yarn path 1*c*** (shown in solid line).

Each weaving cycle involves one revolution of a control shaft 20 of the loom, from which the drives and control functions of all of the units of the loom are derived. A trigger-activated control valve 21 connects a compressed-air nozzle 6 with a compressed-air supply line 22 which is provided with a pressure gauge 23 and connected to a source of compressed air (not shown). The control valve 21 may be adjusted in any way, in accordance with the illustration via an electromagnetic positioning mechanism, in dependence upon the angular position of the control shaft 21, between a closed position as shown, blocking the feed of compressed air to the compressed-air nozzle 6, and an open position permitting compressed air to flow. During the greater part of the weaving cycle the control valve 21 is held in the closed position and it can be opened with switching element only during a predefined fraction of the weaving cycle, which corresponds to a partial revolution of the control shaft 20 through an angle of rotation $\alpha$.

As illustrated the switching segment 24 extends over an angle of rotation $\alpha$=about 90° which corresponds to the starting phase of the weft insertion process when the projectile 14 is being shot into the shed 4. This starting phase also includes at least a portion of the period when the deflector element 16 is being returned from the deflected yarn path 1*c* towards the stretched yarn path la. Accordingly, compressed air at relatively high pressure, e.g., about 2 to 3 bar, is fed to nozzle 6 only during this starting phase so that portion 1' of the weft yarn 1 located upstream of the guide eye 8 is additionally accelerated by a powerful thrust of compressed air in the direction of the weft (arrow 9) while deflector 16 returns to its position 16' shown in phantom lines. This prevents an excessive stressing of weft yarn 1 as it becomes straightened out from yarn path 1*c*. When, after the partial revolution of the control shaft 20 through the angle $\alpha$, the deflector element 16 has reached its position 16' in the region of the yarn path 1*a*, the control valve 21 is closed, thereby cutting off the flow of compressed air during the remainder of the weaving cycle when the weft yarn 1 is drawn off the drum store 5 exclusively by projectile 14, inserted into the shed 4 and, in a final phase of the weft insertion process, braked by actuation of the yarn brake 7.

The start and duration of the actuation of the compressed-air nozzle 6 during a weaving cycle are variable within a range of adjustments determined by the type of loom and its output data to take account of the yarn material which is being woven at the time. The angle of rotation $\alpha$ of the control shaft 20 which determines the actuation of the compressed-air nozzle 6 may therefore be freely chosen within certain limits, e g , within a range of $\alpha$=60° to 120° and be exactly set to correspond to a given range of motion of the deflector element between the positions 16 and 16'.

The compressed-air feed to the compressed-air nozzle 6 may according to one embodiment be so controlled that the maximum air pressure for the additional acceleration of the weft yarn 1 becomes fully effective in the second half of the period intended for the return of the deflector element 16 or of the weft yarn 1 towards the yarn path la. In such an event the portion 1' of the weft yarn 1 upstream of the guide eye 8 becomes preaccelerated to the desired speed just before weft yarn 1 reaches the stretched position from the rest position. In this manner a snatch loading of the weft yarn 1 is avoided.

The pressure of the compressed air for the additional acceleration of the weft yarn 1 may usefully be built up during the first half of the period intended for the return of the weft yarn towards the straightened-out yarn path 1*a*. During this partial phase portion 1' of the weft yarn 1 upstream of the guide eye 8 may be preaccelerated from the rest position to the desired speed independently of the portion 1'' which is downstream of the guide eye 8' and already in motion through the firing of the projectile 14.

For influencing the build-up of pressure in the compressed-air nozzle 6 according to one embodiment of the invention, the start of the compressed-air feed may be varied to commence before the return of the weft yarn 1 towards the yarn path 1*a* begins as determined by the firing of the projectile 14. Such variations are made within a time interval which corresponds with a predetermined fraction, e.g., 10% of the aforesaid period or respectively of an angle of control shaft 20 rotation $\beta$ of about 0% to 10%.

According to one embodiment of the invention, on a loom having a weft insertion speed of about 40 m/sec, an equalized loading of the weft yarn 1 during the weft insertion process may be achieved by controlling the compressed-air feed to the compressed-air nozzle 6 so that the portion 1' of the weft yarn 1 upstream of the guide eye 8 is preaccelerated so that it has a speed which is a predetermined fraction, e.g., half, the speed of the portion 1'' of the weft yarn 1 that is being accelerated by the projectile 14 and is located downstream of the guide eye 8'.

A gentle loading of the weft yarn 1 may further be achieved by controlling the compressed-air feed to the compressed-air nozzle 6 so that the anticipated speed of the compressed air for the preaccelerating portion 1' of the weft yarn 1 is reached essentially within the first third of the period provided for the return of the weft yarn 1 towards the yarn path 1*a*, in the case of the example shown: after a partial revolution of the control shaft 20 through an angle of rotation gamma=about 25% after the firing of the projectile 14.

According to a modified embodiment, in addition to the compressed-air nozzle 6 blowing in the direction of weft insertion (arrow 9), a second compressed-air nozzle (not shown) blowing in the opposite direction may also be provided which, in a known manner, discharges compressed air for braking the weft yarn 1 during an end phase of the weft insertion process, say, via a control valve which may be energized accordingly. In that case the yarn brake 7 may if necessary be omitted or, e.g., for the processing of fine weft yarns, be preserved merely as a member for securing and releasing the weft yarn 1 and energized accordingly in certain angular portions of the weaving cycle. The compressed-air nozzle 6 and the braking nozzle may also be arranged in a combined common unit by energizing them separately from one another.

An arrangement is also possible in which the yarn brake 7 is between the compressed-air nozzle 6 and the deflector device 10. The invention may also be employed for looms having some other weft insertion member, e.g., a gripper belt.

What is claimed is:

1. A method for feeding weft yarn from a weft yarn supply in substantial alignment with a weft yarn path to a weft yarn insertion element of a loom for inserting the weft yarn in a shed formed on the loom during each weaving cycle of the loom, the loom having an air jet nozzle located between the weft yarn source and the element for intermittently accelerating the weft yarn, a movable deflector between the nozzle and the element for moving a portion of the weft yarn out of alignment with the path for taking up slack in the weft yarn towards an end of each loom cycle and, thereafter, for paying out the slack by returning the weft yarn into substantial alignment with the path, the deflector being in a first position when it is in substantial alignment with the path and in a second position when it is out of alignment with the path, and means for attaching the weft yarn to the weft yarn insertion element, the method comprising the steps of moving the insertion element and the attached weft yarn into the shed to thereby commence a weft insertion phase of a weaving cycle, moving the deflector towards a position in which the weft yarn is aligned with the path to pay out the slack in the weft yarn as the element and the weft yarn attached to it move into the shed, discharging pressurized air from the nozzle during at least a part of the insertion phase and over at least a portion of a time when the deflector moves the weft yarn into realignment with the path, and ending the air discharging step no later than when the weft yarn has been realigned with the path and for a remainder of the weaving cycle.

2. A method of feeding weft yarn along a path in a downstream direction from a weft yarn supply to a weft yarn insertion element of a weft yarn insertion mechanism during weaving of a fabric on a loom, the loom forming a shed with warp yarns being woven into the fabric and including an air nozzle between the supply and the element for assisting advancing the weft yarn along the path, a deflector located along the path between the nozzle and the element and movable between first and second positions in a direction transverse to the weft yarn path, the deflector being in substantial alignment with the path when in the first position and being laterally offset from the path when in the second position and including means for engaging the weft yarn to carry the weft yarn with it out of the path as the deflector moves from the first and second positions for taking up slack in the weft yarn, means for moving the insertion element from an insertion side to a receiving side of the shed, thereby commencing a weft insertion phase of a weaving cycle of the loom, means for severing a length of weft yarn inserted in the shed from a remainder of the weft yarn, and means for attaching a free end of the weft yarn remainder to another insertion element for inserting a next length of weft yarn in the shed, the method comprising the steps of moving the deflector during an initial phase of each weaving cycle from the second position towards the first position so that, upon the arrival of the deflector at the first position, previously taken up weft yarn slack is released and the weft yarn again follows the path, discharging pressurized air through the nozzle beginning at about a commencement of the insertion phase of the weaving cycle and while the deflector moves towards its first position to realign the weft yarn with the path, and ending the discharging step no later than when the weft yarn is substantially realigned with the path, whereby a segment of the weft yarn upstream of the deflector is accelerated with the discharged pressurized air to prevent a sudden stressing of the weft yarn by the moving insertion element when the weft yarn becomes realigned with the path.

3. A method according to claims 1 or 2 wherein the step of discharging includes the step of initiating a flow of pressurized air through the nozzle so that a resulting air jet issuing from the nozzle reaches its maximal speed during about a second half of the movement of the deflector from its second position to its first position.

4. A method according to claim 3 including the step of increasing the speed of the air jet issuing from the nozzle to its maximum speed during about a first half of the movement of the deflector from its first position to its second position.

5. A method according to claims 1 or 3 wherein the step of discharging the pressurized air includes the step of initiating a flow of pressurized air to the nozzle at a predetermined time interval prior to an initiation of the movement of the deflector from its second position towards its first position.

6. A method according to claim 5 wherein the predetermined time interval is about 10% of the time it takes for the deflector to move from its first position to its second position.

7. A method according to claims 1 or 2 wherein the insertion element moving from the receiving side into the shed moves a weft yarn segment downstream of the deflector at a given speed, and including the step of controlling a flow of air to the nozzle so that a weft yarn segment upstream of the deflector is accelerated by an air jet issuing from the nozzle to a speed which has a predetermined relationship to the speed of the weft yarn segment downstream of the deflector.

8. A method according to claim 7 wherein the step of controlling the flow of air includes accelerating the upstream weft yarn segment with the air jet to a speed of about half the speed imparted to the downstream weft yarn segment by the insertion element.

9. A method according to claim 7 wherein the step of controlling the air flow to the nozzle includes the step of flowing air of a sufficient pressure to the nozzle so that the weft yarn segment upstream of the deflector is accelerated by the air jet issuing from the nozzle to said speed which has a predetermined relationship within about one-third of the time required for the deflector to move from its second position to its first position.

10. A method according to claim 1 wherein the ending step comprises terminating the discharge of pressurized air for a remainder of the weaving cycle following the substantial realignment of the weft yarn with the path.

11. A method according to claim 10 wherein the terminating step occurs when the deflector arrives at its first position.

12. A loom for weaving weft and warp yarns into a fabric, the loom comprising a weft yarn supply, means for forming a shed with the warp yarns, a weft yarn insertion mechanism including an element for inserting weft yarn in the shed, a weft yarn guide for directing weft yarn along a path in a downstream direction from the weft yarn supply to the weft yarn insertion element, an air nozzle between the supply and the element for intermittently assisting advancing the weft yarn along the path, a deflector located along the path between the nozzle and the element and movable between first and second positions in a direction transverse to the weft yarn path, the deflector being in substantial alignment with the path when in the first position and being laterally offset from the path when in the second position and including means for engaging the weft yarn to carry the weft yarn with it out of the path as the deflector moves from the first and second positions for taking up slack in the weft yarn, means for moving the insertion element from an insertion side to a receiving side of the shed, thereby commencing a weft yarn insertion phase of a weaving cycle of the loom, means for severing a length of weft yarn inserted in the shed from a remainder of the weft yarn, means for attaching a free end of the weft yarn remainder to another insertion element for inserting a next length of weft yarn in the shed during the next weaving cycle, means for moving the deflector during an initial phase following a commencement of each weaving cycle from the second position towards the first position so that, upon the arrival of the deflector at the first position, previously taken up weft yarn slack is released and the weft yarn becomes realigned with the path, a valve for connecting the nozzle with a source of pressurized air, and means for sequentially opening and closing the valve during the initial phase of the cycle for timing the discharge of pressurized air through the nozzle to begin at about a commencement of the weft insertion phase of the weaving cycle and while the deflector moves towards its first position to realign the weft yarn with the path, and to end no later than when the weft yarn is substantially realigned with the path to thereby accelerate a segment of the weft yarn upstream of the deflector with the discharged pressurized air to prevent a sudden stressing of the weft yarn by the moving insertion element when the weft yarn becomes realigned with the path.

13. A loom according to claim 12 wherein the means for sequentially opening and closing the valve includes a valve actuator and a control shaft, a full revolution of the control shaft determining the duration of a weaving cycle, and means operatively coupled to the control shaft and the valve actuator for opening the valve and thereby discharging pressurized air from the nozzle while the control shaft rotates through a predetermined angle of rotation in the range of between about 60° and 120°.

14. Apparatus according to claim 13 wherein the predetermined angle of rotation is about 90°.

* * * * *